US011437788B2

(12) United States Patent
Ritter et al.

(10) Patent No.: US 11,437,788 B2
(45) Date of Patent: Sep. 6, 2022

(54) METHOD FOR MANUFACTURING A SPARK PLUG ELECTRODE SYSTEM AND A SPARK PLUG, SPARK PLUG ELECTRODE SYSTEM, AND SPARK PLUG

(71) Applicant: Robert Bosch GmbH, Stuttgart (DE)

(72) Inventors: Ronald Ritter, Notzingen (DE); Igor Orlandini, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/260,481

(22) PCT Filed: May 23, 2019

(86) PCT No.: PCT/EP2019/063380
§ 371 (c)(1),
(2) Date: Jan. 14, 2021

(87) PCT Pub. No.: WO2020/025184
PCT Pub. Date: Feb. 6, 2020

(65) Prior Publication Data

US 2021/0273417 A1 Sep. 2, 2021

(30) Foreign Application Priority Data

Aug. 2, 2018 (DE) ..... 102018212894.9

(51) Int. Cl.

| | |
|---|---|
| ***H01T 13/22*** | (2006.01) |
| ***H01T 13/32*** | (2006.01) |
| ***H01T 13/39*** | (2006.01) |
| ***H01T 21/02*** | (2006.01) |

(52) U.S. Cl.
CPC ..... *H01T 13/22* (2013.01); *H01T 13/32* (2013.01); *H01T 13/39* (2013.01); *H01T 21/02* (2013.01)

(58) Field of Classification Search
CPC ..... H01T 13/22; H01T 13/32; H01T 13/39; H01T 21/02; H01T 13/467; H01T 13/20
See application file for complete search history.

(56) References Cited

U.S. PATENT DOCUMENTS

| | | | | |
|---|---|---|---|---|
| 4,730,582 A * | 3/1988 | Lindsay | F02P 15/08 | 123/169 MG |
| 5,007,389 A * | 4/1991 | Kashiwara | H01T 13/32 | 123/169 CL |
| 5,408,961 A * | 4/1995 | Smith | H01T 13/32 | 123/169 EL |

(Continued)

FOREIGN PATENT DOCUMENTS

| | | |
|---|---|---|
| CN | 105637216 A | 6/2016 |
| DE | 102015103666 B3 | 1/2016 |

(Continued)

OTHER PUBLICATIONS

International Search Report for PCT/EP2019/063380, dated Jul. 23, 2019.

*Primary Examiner* — Kevin Quarterman
(74) *Attorney, Agent, or Firm* — Norton Rose Fulbright US LLP; Gerard Messina

(57) ABSTRACT

A method for manufacturing a spark plug electrode system including a ground electrode and a center electrode, which are connected to each other by a joining area, formed from a one-piece spark plug electrode base body made up of spark plug electrode material.

27 Claims, 3 Drawing Sheets

(56) References Cited

U.S. PATENT DOCUMENTS

| | | | | |
|---|---|---|---|---|
| 5,731,655 | A * | 3/1998 | Corrado | H01T 13/14 313/138 |
| 6,064,144 | A * | 5/2000 | Knoll | H01T 13/39 313/138 |
| 8,853,926 | B2 * | 10/2014 | Morin | H01T 13/39 313/141 |
| 2002/0055318 | A1 | 5/2002 | Ishiguro et al. | |
| 2005/0215160 | A1 * | 9/2005 | Kolp | H01T 21/02 445/7 |
| 2009/0167135 | A1 * | 7/2009 | Morin | H01T 13/54 313/141 |
| 2013/0002122 | A1 | 1/2013 | Kowalski et al. | |
| 2013/0206122 | A1 | 8/2013 | Chiera et al. | |

FOREIGN PATENT DOCUMENTS

| | | | |
|---|---|---|---|
| EP | 2621038 | A2 | 7/2013 |
| JP | 2002014154 | A | 1/2002 |
| JP | 2008300278 | A | 12/2008 |

* cited by examiner

METHOD FOR MANUFACTURING A SPARK PLUG ELECTRODE SYSTEM AND A SPARK PLUG, SPARK PLUG ELECTRODE SYSTEM, AND SPARK PLUG

FIELD

The present invention relates to a method for manufacturing a spark plug electrode system and to a method for manufacturing a spark plug. In addition, the present invention also relates to a spark plug electrode system and a spark plug, which is manufactured by utilizing the spark plug electrode system.

BACKGROUND INFORMATION

During the manufacture of spark plugs, the center electrode intended therefor and the ground electrode are manufactured separately from one another and are installed one after the other. This means, the center electrode is connected to an electrical connection area and the ground electrode is usually connected to the housing of the spark plug. Due to this separate manufacture and arrangement of the electrodes, it is difficult to achieve a precise distance between the electrodes, which is significant for an efficient and consistently good formation of an ignition spark.

SUMMARY

In accordance with an example embodiment of the present invention, a method for manufacturing a spark plug electrode system is provided, which makes it possible to manufacture a spark plug including an exactly predefined distance between the ground electrode and the center electrode.

According to the example method, a spark plug electrode system including a ground electrode and a center electrode is manufactured. This also includes the possibility that multiple ground electrodes and/or multiple center electrodes may be provided. The ground electrode and the center electrode are connected to each other by a joining area, which is formed between the ground electrode and the center electrode. The joining area stabilizes the distance of the ground electrode from the center electrode. The electrode spacing results, therefore, not afterwards due to the placement of the electrodes at a spark plug base body, but rather in advance due to the formation of the spark plug electrode system. For this purpose, the ground electrode, the center electrode, and the joining area are formed from a one-piece spark plug electrode base body made up of spark plug electrode material. The ground electrode, the center electrode, and the joining area are therefore formed in a one-piece and contiguous manner. This means, in other words, that the distance between the electrodes results from the component geometry of the spark plug electrode system and, specifically, is not due to the separate placement of the electrodes during the assembly of the spark plug. As a result, it becomes possible to precisely and uniformly form the electrode spacing of all center electrodes and all ground electrodes and, thereby, all spark gaps without high technical complexity.

The spark plug electrode base body is specifically not limited and may have any shape and layer thickness, which are suitable for forming at least one ground electrode, at least one center electrode, and a joining area.

Likewise, the spark plug electrode material is also essentially not limited. Nickel has proven to be particularly suitable as base material, since nickel is distinguished by a high temperature resistance, oxidation resistance, and wear resistance. The spark plug electrode material therefore advantageously includes at least 50 mass percent nickel. Particularly advantageously, the spark plug electrode material is made up of a nickel-chromium alloy or a nickel-yttrium alloy.

Preferred refinements of the present invention are described herein.

The ground electrode, the center electrode, and the joining area may be manufactured in different ways, provided these components of the spark plug electrode system are formed as one piece and, thereby, from a continuous material.

According to one advantageous refinement of the present invention, the formation of the ground electrode, the center electrode, and the joining area includes a step of removing spark plug electrode material from the spark plug electrode base body. This may be carried out in a technically very simple and relatively quick manner and makes it possible to form the components of the spark plug electrode system precisely with respect to geometry and shape.

Moreover, advantageously, the method may also provide a step of forming an ignition spark gap between the ground electrode and the center electrode. According to this specific embodiment, the ignition spark gap is also advantageously formed by removing spark plug electrode material from the spark plug electrode base body, the ground electrode and the center electrode continuing to remain connected to each other by the joining area made up of the spark plug electrode material. The ignition spark gap therefore obtains a specific geometric shape, which is necessary for a consistently good formation of an ignition spark. Due to the removal of spark plug electrode material, the ignition spark gap may be easily adapted to the conditions in the engine compartment, in a predetermined shape and position, and formed without high technical complexity. In particular, as a result, the spark gap between all ground electrodes and center electrodes may also be arbitrarily set in the radial direction perpendicular to the longitudinal axis of the spark plug.

Any suitable method may be utilized, in principle, to remove the spark plug electrode material from the spark plug electrode base body. The removal is particularly simple, cost-effective, and precise via punching or material removal or eroding or lasering. These methods, utilized individually or in combination, are therefore particularly preferable.

In order to form a desired three-dimensional embodiment of the ground electrode, the center electrode, and the joining area in a cost-effective manner due to the reduction of spark plug electrode material, the method may further advantageously include a step of deep drawing at least one area of the spark plug electrode base body. Therefore, individual subareas may be selectively formed by deep drawing and, thereby, obtain the desired shape.

Alternatively or in addition to the removal of spark plug electrode material from the spark plug electrode base body, the ground electrode, the center electrode, and the joining area connecting the ground electrode and the center electrode may be formed as one piece via a step of building up spark plug electrode material. For this purpose, the spark plug electrode material may be deposited, for example, on a suitable carrier in such a way that the ground electrode, the center electrode, and the joining area are formed as one piece and, thereby, contiguously. The carrier may be removed after the completion of the one-piece spark plug electrode system. Suitable material-adding methods include conventional CVD or PVD. Moreover, an advantage of this embodiment is that a three-dimensional spark plug electrode system may be obtained via the material build-up without further formation steps. As a result, therefore, time and costs for the manufacture of the spark plug electrode system may be saved.

The build-up of the spark plug electrode material is advantageously carried out via 3D printing in a particularly simple manner and while maintaining precise geometric specifications. The shape and design of the spark plug electrode system may be established in advance with the aid of a CAD method, so that a true-to-scale build-up of the spark plug electrode system is controllable in a targeted manner.

In one further advantageous refinement of the present invention, the ground electrode encompasses the center electrode at least in sections. As a result, the ignition spark gap may be precisely formed and the ignition spark formation controlled in a precise manner with respect to location. The ground electrode may be present, advantageously, in the form of a cylindrical ring around the center electrode, the center electrode being present, further advantageously, in the form of a cylinder. The cylindrical ring and the cylinder are connected to each other by the joining area. Due to the absence of corners, an erosive wear and material removal due to the ignition spark formation may be prevented as a result.

Moreover, the joining area is advantageously designed in the form of at least one web, which connects the ground electrode and the center electrode to each other. A web offers, in combination with minor geometric extension, a very good option for stabilizing the distance between the ground electrode and the center electrode and is easily implementable by removing spark plug electrode material from the spark plug electrode base body as well as by building up spark plug electrode material.

Due to the improvement of the stabilization of the distance between the ground electrode and the center electrode, the joining area includes two to four webs, which connect the ground electrode and the center electrode to each other. The higher the number of webs is, the greater is the stabilization of the electrode spacing. A number of more than four webs may also be more difficult to implement and may be obstructive during the further processing of the spark plug electrode system, however. A number of two to four webs has therefore proven to be optimal.

In order to improve the wear resistance of the spark plug electrodes, it is advantageous, moreover, when one of the electrodes or when even both electrodes include(s) at least one noble metal in the area of the spark gap. Advantageously, the method therefore includes a step of placing at least one first noble metal at the ground electrode and/or at least one second noble metal at the center electrode, the first noble metal and/or the second noble metal being placed in such a way that they are situated in an area forming a spark gap between the ground electrode and the center electrode. The noble metal may be applied directly onto the appropriate electrode areas or, however, is situated in the form of a noble metal body, such as, for example, a noble metal pin or a noble metal small plate or a noble metal cylinder, in the appropriate electrode area. Provided that the ground electrode as well as the center electrode is furnished with noble metal, the spark gap is therefore formed between the first noble metal of the ground electrode on the one side and the second noble metal of the center electrode on the other side.

In order to improve the distribution of the gas flows in the combustion chamber of the spark plug, in accordance with an example embodiment of the present invention, the method for manufacturing a spark plug electrode system may further include a step of providing openings in the ground electrode and/or in the center electrode. One or multiple opening(s) is/are advantageously provided here. Due to the openings, for example, combustion gas or oxygen or air may better flow around the electrodes and exhaust air after combustion of the combustion gas may be better transported away from the electrodes. As a result, the efficiency of the ignition spark formation may be increased and the power of a spark plug manufactured with the aid of the spark plug electrode system manufactured according to the present invention may be improved.

Moreover, according to an example embodiment of the present invention, a method for manufacturing a spark plug is also provided. The spark plug includes a spark plug electrode system including a ground electrode and a center electrode, which are connected to each other via a joining area, formed from a one-piece spark plug electrode base body made up of spark plug electrode material. Here, the spark plug electrode system may be manufactured in the manner described above. In the manufacture of the spark plug according to the present invention, a step of connecting the spark plug electrode system to a spark plug base body is also provided.

The spark plug base body may include a housing, an electrical connection area for the center electrode, and an insulator. Since details of spark plug base bodies are understood by those skilled in the art, appropriate further explanations may be dispensed with here.

Due to the one-piece and, thereby, integral formation of the ground electrode, the center electrode, and a joining area connecting the two electrodes formed from a one-piece spark plug electrode base body made up of spark plug electrode material, a specific electrode spacing is automatically implemented, due to the previously established component geometry of the spark plug electrode system, which is permanently established and does not need to be set afterward in a tedious and complex manner after placement of the electrodes at the spark plug base body. Due to the method according to the present invention for manufacturing a spark plug, a spark plug having a consistently high power density may be manufactured in a cost-effective and technically simple manner.

A permanently good placement of the electrodes without the possibility of generating electrical short circuits may be advantageously implemented with the aid of the further refinement, in which the ground electrode is connected to a housing of the spark plug and/or the center electrode is connected to an electrical terminal for the center electrode. As a result, the electrodes are also fastened at the spark plug base body in a permanently stable manner, which enhances the mechanical stability of the spark plug to be manufactured.

The connection preferably takes place here in an integrally joined manner, the method specifically not being restricted to the connection in an integrally joined manner. Particularly advantageously due to a very good and stable connection formation, the connection may be carried out with the aid of laser welding, with the aid of resistance welding, or with the aid of brazing.

In order to suppress electrical short circuits between the ground electrode and the center electrode, the method may include, moreover, a step of removing the joining area between the ground electrode and the center electrode. The removal may be carried out, for example, by milling, material removal, eroding, or via treatment using a laser. The removal of the joining area is carried out, in particular, in such a way that no material residue of the joining area protrudes from the ground electrode or the center electrode, so that the spark gap between the electrodes is not adversely affected. The particular surfaces of the center electrode and the ground electrode are therefore flat. Provided that a first noble metal and a second noble metal are situated on the ground electrode and/or the center electrode, the removal of the joining area may take place up to the surface of the particular noble metal, in order not to produce any notches or recesses in the noble metal, which may result in the formation of erroneous sparks. The opposing surfaces of the first noble metal and of the second noble metal are therefore also flat. Preferably, however, the removal of the joining area takes place in such a way that the joining area situated between the first noble metal and/or the second noble metal is also at least partially removed. This results, at least, in the formation of exposed corners at the particular noble metal, at which field enhancements in the electric field are present, so that the ignition voltage demand for forming the ignition spark is reduced. The joining area may also be completely removed between the particular noble metal.

As described above for the method for manufacturing a spark plug electrode system, the method for manufacturing a spark plug may also include a step of providing openings in the ground electrode and/or in the center electrode, the openings being utilized for better distributing the reaction gases and exhaust gases. The openings may therefore be already provided during the manufacture of the spark plug electrode system, or, however, also not until the manufacture of the spark plug, in order to better correspond to customer wishes, if necessary. Appropriate openings may also be provided at both points in time.

Moreover, according to an example embodiment of the present invention, a spark plug electrode system, which is suitable for installation in a spark plug, is also provided. The spark plug electrode system according to an example embodiment of the present invention includes a ground electrode and a center electrode, which are connected to each other by a joining area. Here, the spark plug electrode system is formed as one piece from a spark plug electrode material, so that the ground electrode, the center electrode, and the joining area are integrally joined and, thereby, manufactured from the same material without a ledge or subsequent mounting. As a result, the distance between the electrodes necessary for forming a stable ignition spark results directly from the component geometry of the spark plug electrode system. Likewise, a predefined ignition spark gap is therefore provided, which allows for a precise local control of the ignition spark formation. Due to the one-piece design, the spark plug electrode system according to the present invention is compact and easily storable or transportable and installable. The joining area is preferably removed only after the installation of the spark plug electrode system including the spark plug.

The spark plug electrode system according to the present invention is manufacturable with the aid of the method according to the present invention for manufacturing a spark plug electrode system. Consequently, the particular advantages, advantageous effects, and refinements also have reciprocal usage.

According to one advantageous refinement of the present invention, the center electrode is cylindrically designed and/or the ground electrode is designed in the form of a cylindrical ring and/or the joining area is formed from at least one, preferably two to four web(s). Due to the cylindrical configuration of the center electrode and also of the ground electrode, interfering sparks may be prevented. The ground electrode preferably completely encompasses the center electrode in this case. One or multiple web(s) is/are utilized for stabilizing the placement of the ground electrode and the center electrode, at least two webs being preferred for stability reasons and maximally four webs being preferred for production reasons.

Likewise, according to the present invention, a spark plug is also provided, which is manufactured with the aid of the above-described method for manufacturing a spark plug. Due to the one-piece manufacture of the ground electrode, the center electrode, and the joining area connecting the two electrodes, a permanently stable electrode spacing may also be implemented in the spark plug according to the present invention. The joining area is then removed before a utilization of the spark plug.

In addition, according to the present invention, a spark plug is also described, which includes a ground electrode and a center electrode, which, between themselves, define a spark gap, the ground electrode encompassing the center electrode, a first noble metal being situated at the ground electrode in an area forming a spark gap between the ground electrode and the center electrode. Alternatively or additionally, a second noble metal is situated in an area forming a spark gap between the ground electrode and the center electrode.

Due to the noble metal provided at one electrode or at multiple electrodes, the spark plug is distinguished by a high wear resistance and good ignition spark formation. The first noble metal includes at least one section, which is free of the first noble metal. Alternatively or additionally, the second noble metal includes at least one section, which is free of the second noble metal. The existing sections may contain spark plug electrode material, so that the surface of the particular noble metal is flat.

These noble metal-free sections result due to the fact that the spark plug is manufacturable as described above with the aid of the method according to the present invention for manufacturing a spark plug. As presented in the description of this method, initially a spark plug electrode system is manufactured, in which the ground electrode and the center electrode are connected to each other by a joining area. Since first noble metal is applied onto one or multiple area(s) of the ground electrode and/or second noble metal is applied onto one or multiple area(s) of the center electrode thereafter, i.e., only afterward, after formation of the electrodes and the joining area, the particular noble metal being situated in the spark gap between the ground electrode and the center electrode, the subareas of the ground electrode and of the center electrode, which include the joining area, may include no noble metal.

Therefore, depending on the number of webs removed in the course of the method for manufacturing the spark plug, an appropriate number of noble metal-free sections result at the ground electrode and at the center electrode. Depending on to what degree the joining area encompassed by noble metal is removed, these sections may include the same spark plug electrode material from which the spark plug electrode base body—which includes the ground electrode, the center electrode, and the joining area—is also formed. Preferably, however, the removal of the joining area has taken place in such a way that the joining area situated between the first noble metal and/or the second noble metal is also at least partially removed. This results in exposed areas between the first noble metal and/or the second noble metal and resultant corners at the particular noble metal, at which field enhancements in the electric field are present, so that the ignition voltage demand for the ignition spark formation is reduced.

This spark plug according to an example embodiment of the present invention includes a permanently stable geometric placement of the electrodes and, thereby, a precisely formed spark gap as well as a high wear resistance and, thereby, a long service life.

BRIEF DESCRIPTION OF THE DRAWINGS

Exemplary embodiments of the present invention are described in detail below with reference to the figures.

DETAILED DESCRIPTION OF EXAMPLE EMBODIMENTS

Figure 1:
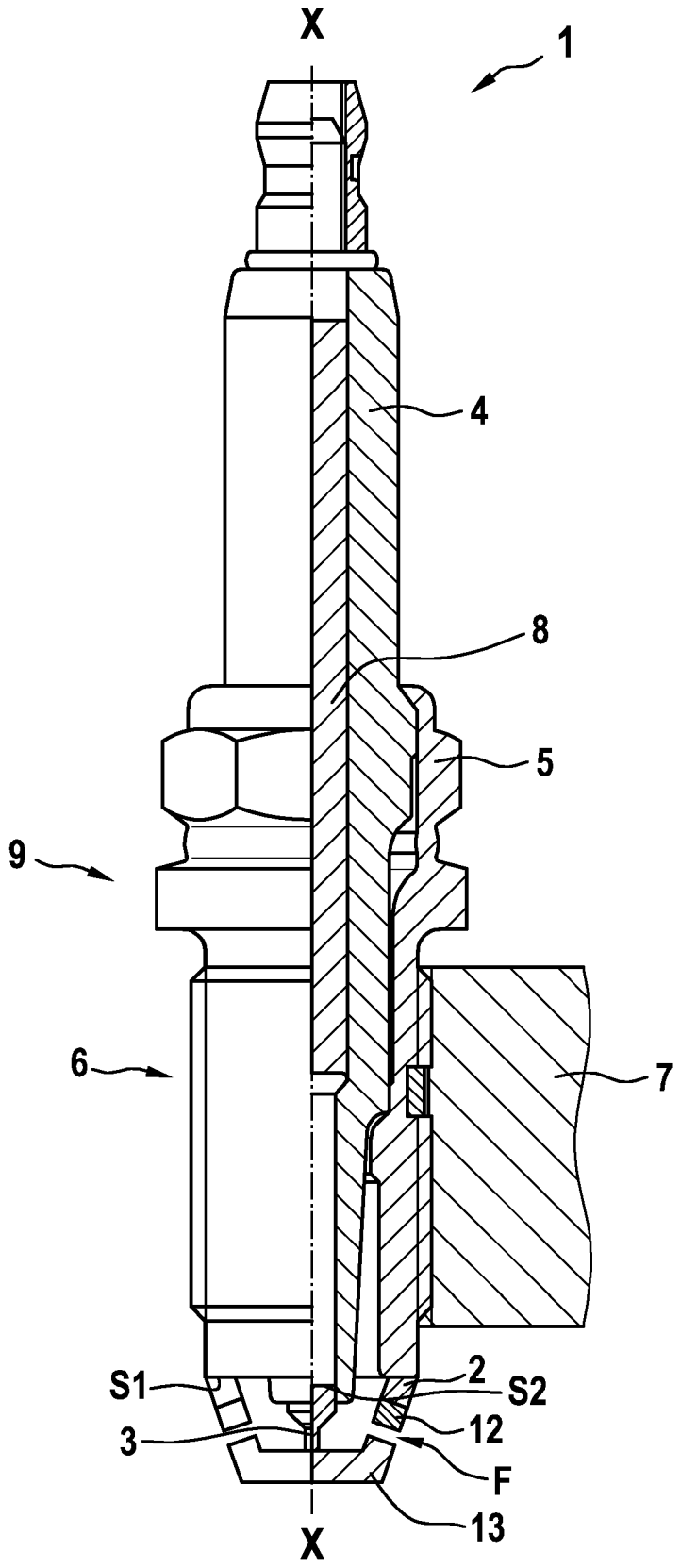
FIG. 1 shows a partial sectional view of a spark plug according to a first specific embodiment of the present invention.

Only the details of main features of the present invention are represented in the figures. All other details have been omitted for the sake of clarity. In addition, identical reference numerals relate to identical components.

As is shown in FIG. 1, spark plug 1 encompasses a ground electrode 2, a center electrode 3, and an insulator 4. A housing 5 at least partially encompasses insulator 4. A thread 6, which is designed for fastening spark plug 1 in a cylinder head 7, is situated at housing 5. Center electrode 3 is connected to an electrical terminal 8 in order to generate an ignition spark.

In spark plug 1 from FIG. 1, ground electrode 2 and center electrode 3 are formed from the same material, namely in such a way that ground electrode 2 and center electrode 3, initially connected to each other by a joining area, are formed from a one-piece spark plug electrode base body made up of spark plug electrode material, for example, by deep drawing the spark plug electrode base body.

A first noble metal 12 is then situated on ground electrode 2 and a second noble metal 13 is situated on center electrode 3, a spark gap F being formed between first noble metal 12 and second noble metal 13.

In one further step, the spark plug electrode base body is connected to a spark plug base body 9, which, as shown here, includes housing 5, insulator 4, and electrical terminal 8.

As shown here, ground electrode 2 is connected to housing 5 preferably by a first welded joint S1 and center electrode 3 is advantageously connected to electrical terminal 8 by a second welded joint S2. The joining area, which was initially formed between ground electrode 2 and center electrode 3, has been removed in order to start up spark plug 1.

Due to the fact that ground electrode 2 and center electrode 3 as well as noble metals 12, 13 respectively situated thereon are manufactured in that a joining area is formed between ground electrode 2 and center electrode 3, the electrode spacing between first noble metal 12 of ground electrode 2 and second noble metal 13 of center electrode 3 in spark plug 1 represented in FIG. 1 is permanently stable and highly precisely set to a predetermined distance. Consequently, spark plug 1 is distinguished by a high power density and a low spark-erosive wear.

Figure 2:
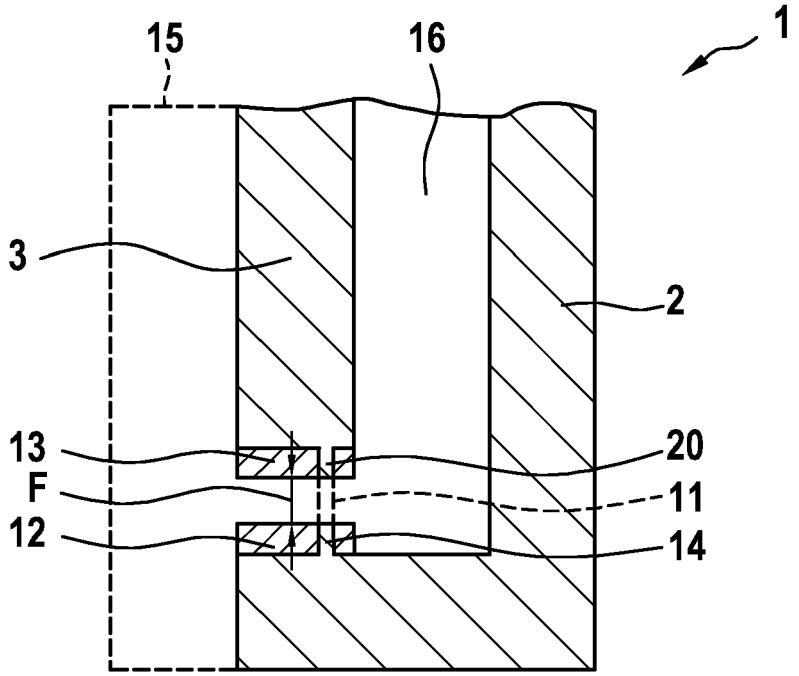
FIG. 2 shows a cut view of a spark plug according to a second specific embodiment of the present invention.

FIG. 2 shows a partial section of a spark plug 1 according to a second specific embodiment. Ground electrode 2 is designed in the form of a roof electrode and projects over center electrode 3. At the combustion chamber-side end of center electrode 3, center electrode 3 includes a second noble metal 13, which is designed in the form of a box-shaped or cylindrical small plate. Diametrically opposed thereto, a first noble metal 12, likewise in the form of a box-shaped or cylindrical small plate, is situated at ground electrode 2. Spark gap F is formed between first noble metal 12 and second noble metal 13. The ignition spark is generated here. First noble metal 12 includes a noble metal-free section 14 and second noble metal 13 includes a noble metal-free section 20.

Noble metal-free sections 14, 20 result from the manufacture of spark plug 1. For the manufacture of spark plug 1 according to the second specific embodiment, a spark plug electrode system, which includes a ground electrode 2, a center electrode 3, and a joining area 11, designed as one piece, is connected to a spark plug base body. The spark plug electrode system is formed from a one-piece spark plug electrode base body made up of spark plug electrode material. Joining area 11 is indicated by dashed lines in FIG. 2.

A spark plug electrode base body 15 to be utilized for this purpose may be designed to be, for example, box-shaped or fully cylindrical. One possible contour of a spark plug electrode base body 15 of this type is represented in FIG. 2 by dashed lines. The spark plug electrode material preferably includes nickel as the main element and is made up, in particular, of a nickel-chromium alloy or a nickel-yttrium alloy.

Ground electrode 2, center electrode 3, and a joining area 11 connecting ground electrode 2 and center electrode 3 may be formed from spark plug electrode base body 15, for example, by removing spark plug electrode material. The removal of spark plug electrode material may be carried out particularly well with the aid of a material-removing process, via eroding, via treatment with the aid of a laser, or by punching. In addition, as a result, spark gap F as well as further free areas 16 may be formed between ground electrode 2 and center electrode 3. Joining area 11 is formed between the combustion chamber-side end of center electrode 3 and the area of ground electrode 2 diametrically opposed to the combustion chamber-side end of center electrode 3.

Ground electrode 2, center electrode 3, and joining area 11 are therefore formed as one piece from the same material. In one further method step, first noble metal 12 is applied onto ground electrode 2 and second noble metal 13 is applied onto center electrode 3, so that first noble metal 12 and second noble metal 13 are positioned opposite one another in the area of the spark gap. Joining area 11 between ground electrode 2 and center electrode 3 is only removed in a step downstream from this method step. As a result, a noble metal-free section 20 remains at center electrode 3 and a noble metal-free section 14 remains at ground electrode 2. Noble metal-free sections 14, 20 may contain spark plug electrode material, provided that the spark plug electrode material of the former joining area has not also been removed in these areas.

Figure 3:
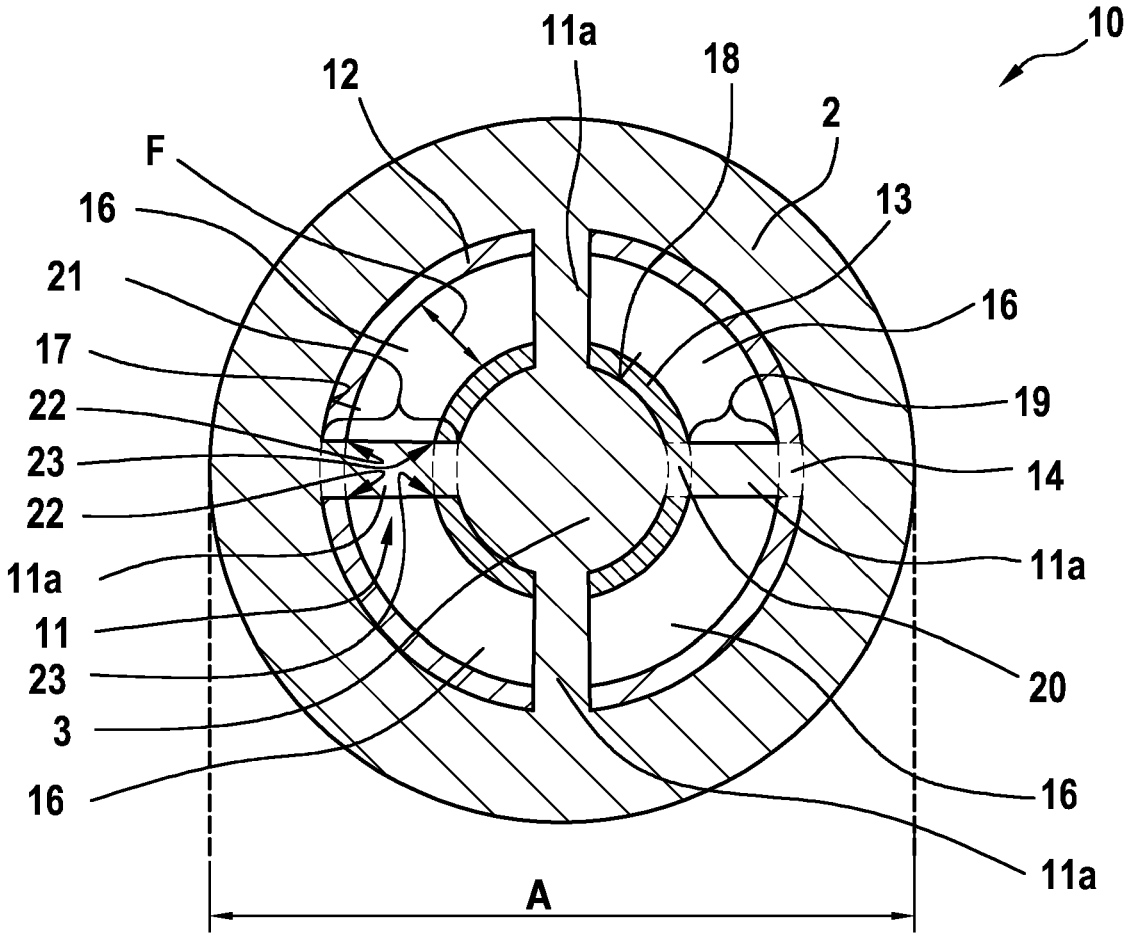
FIG. 3 shows a cross section of a spark plug electrode system according to a third specific embodiment of the present invention.

FIG. 3 shows a spark plug electrode system 10 according to a third specific embodiment of the present invention. Spark plug electrode system 10 includes a center electrode 3, which is encompassed by a ground electrode 2 in the manner of a cylindrical ring. Center electrode 3 and ground electrode 2 are connected to each other by a joining area 11. Spark plug electrode system 10 is manufactured from a one-piece spark plug electrode base body, so that ground electrode 2, center electrode 3, and joining area 11 are also formed as one piece in spark plug electrode system 10, i.e., also from the same material without ledges or joining seams.

One exemplary method for manufacturing ground electrode 2, center electrode 3, and joining area 11 includes a step of removing spark plug electrode material from the spark plug electrode base body. In the specific embodiment shown in FIG. 3, the spark plug electrode base body may have, for example, a fully cylindrical shape having a diameter A. Diameter A is preferably maximally as great as the inner diameter of the housing of the spark plug, in which spark plug electrode system 10 is to be installed, so that an accurate fastening of spark plug electrode system 10 is easily possible.

By removing spark plug electrode material, four free areas 16 result, which are to be allocated to spark gap F.

Alternatively to the above-described method, ground electrode 2, center electrode 3, and joining area 11 may also be formed as one piece by building up spark plug electrode material, for example, by utilizing a 3D printing method.

In the present specific embodiment, joining area 11 is made up of four webs 11*a*, which are situated at a 90° angle with respect to one another.

A first noble metal 12 is situated on inner surface 17 of ground electrode 2 facing center electrode 3. A second noble metal 13 is situated on outer surface 18 of center electrode 3 facing ground electrode 2. First noble metal 12 and second noble metal 13 are not situated in joining area 11.

Spark gap F results between first noble metal 12 and second noble metal 13.

In order to manufacture a spark plug by utilizing spark plug electrode system 10 shown here, joining area 11 made up of four webs 11*a* is removed. For example, sections 19 of the webs may be removed, so that ground electrode 2 and center electrode 3 are no longer electrically connected to each other. Sections 19 are situated between first noble metal 12 and second noble metal 13 in open area 16. By removing sections 19, sections 14 remain at ground electrode 2, which are noble metal-free but contain spark plug electrode material and sections 20 remain at center electrode 3, which are noble metal-free but contain spark plug electrode material. These therefore extend through first noble metal 12 and second noble metal 13.

Preferably, the removal of joining area 11 takes place in such a way that joining area 11 situated between first noble metal 12 and second noble metal 13 is also at least partially removed. Therefore, a section 21 is removed, as represented in FIG. 3. This results in the formation of open areas between first noble metal 12 on the one side and second noble metal 13 on the other side and, moreover, to exposed corners 22 of first noble metal 12 and exposed corners 23 of second noble metal 13, at which field enhancements in the electric field are present, so that the ignition voltage demand for the ignition spark formation may be reduced.

After the removal of joining area 11, center electrode 3 has a fully cylindrical shape and ground electrode 2 has the shape of a cylindrical ring.

By providing joining area 11 and the one-piece design of ground electrode 2, center electrode 3, and joining area 11, a fixed and precisely predeterminable electrode spacing results, due to the geometric configuration of spark plug electrode system 10, from which a precisely formed spark gap F also results after the application of first noble metal 12 and second noble metal 13. A spark plug manufactured by utilizing spark plug electrode system 10 according to the present invention is distinguished by a high power density and a low spark-erosive wear.

What is claimed is:

1. A method for manufacturing a spark plug electrode system including a ground electrode and a center electrode, which are connected to each other by a joining area, the method comprising:

forming the ground electrode, the center electrode, and the joining area together from a one-piece spark plug electrode base body made up of spark plug electrode material;

wherein the spark plug electrode material is a nickel-chromium alloy or a nickel-yttrium alloy.

2. The method as recited in claim 1, wherein the formation of the ground electrode, the center electrode, and the joining area includes removing spark plug electrode material from the spark plug electrode base body.

3. The method as recited in claim 2, further comprising:

forming an ignition spark gap between the ground electrode and the center electrode by removing spark plug electrode material from the spark plug electrode base body, the ground electrode and the center electrode remaining connected to each other by the joining area made up of the spark plug electrode material.

4. The method as recited in claim 2, wherein the removal of the spark plug electrode material from the spark plug electrode base body is carried out via punching or material removal or eroding or lasering.

5. The method as recited in claim 1, further comprising:

deep drawing at least one area of the spark plug electrode base body.

6. The method as recited in claim 1, further comprising:

building up spark plug electrode material in such a way that the ground electrode, the center electrode, and the joining area connecting the ground electrode and the center electrode, are formed as one piece.

7. The method as recited in claim 6, wherein the build-up of spark plug electrode material takes place in such a way that an ignition spark gap is formed between the ground electrode and the center electrode, the ground electrode and the center electrode remaining connected to each other by the joining area made up of the spark plug electrode material.

8. The method as recited in claim 6, wherein the build-up of the spark plug electrode material is carried out by 3D printing.

9. The method as recited in claim 1, wherein the ground electrode encompasses the center electrode at least in sections.

10. The method as recited in claim 1, wherein the joining area is in the form of at least one web, which connects the ground electrode and the center electrode to each other.

11. The method as recited in claim 10, wherein the joining area includes two to four webs, which connect the ground electrode and the center electrode to each other.

12. The method as recited in claim 1, further comprising:

situating at least one first noble metal at the ground electrode and/or at least one second noble metal at the center electrode, the first noble metal and/or the second noble metal being situated in such a way that they are situated in an area forming a spark gap between the ground electrode and the center electrode.

13. The method as recited in claim 1, further comprising:

providing openings in the ground electrode and/or in the center electrode.

14. The method as recited in claim 1, wherein the ground electrode is a cylindrical ring, the center electrode is a cylinder, and the joining area includes a plurality of webs which each connect the ground electrode to the center electrode, the plurality of webs being separated from one another by free areas which are free from all materials.

15. A method for manufacturing a spark plug including a spark plug electrode system including a ground electrode and a center electrode, which are connected to each other by a joining area, formed from a one-piece spark plug electrode base body made up of spark plug electrode material, the method comprising:

connecting the spark plug electrode system to a spark plug base body;

wherein the spark plug electrode material is a nickel-chromium alloy or a nickel-yttrium alloy.

16. The method as recited in claim 15, wherein the ground electrode is connected to a housing of the spark plug and/or the center electrode is connected to an electrical terminal for the center electrode.

17. The method as recited in claim 15, wherein the connection is carried out using laser welding, or using resistance welding, or using brazing.

18. The method as recited in 15, further comprising:

removing the joining area between the ground electrode and the center electrode.

19. The method as recited claim 15, further comprising:

providing openings in the ground electrode and/or in the center electrode.

20. The method as recited in claim 15, wherein the ground electrode is a cylindrical ring, the center electrode is a cylinder, and the joining area includes a plurality of webs which each connect the ground electrode to the center electrode, the plurality of webs being separated from one another by free areas which are free from all materials.

21. The method as recited in claim 20, further comprising:

after connecting the spark plug electrode system to the spark plug base body, removing the joining area including the plurality of webs between the ground electrode and the center electrode.

22. A spark plug electrode system, comprising:

a ground electrode and a center electrode connected to each other by a joining area, the spark plug electrode system being formed as one piece from a spark plug electrode material;

wherein the spark plug electrode material is a nickel-chromium alloy or a nickel-yttrium alloy.

23. The spark plug electrode system as recited in claim 22, wherein the center electrode is cylindrically designed and/or the ground electrode is designed in the form of a cylindrical ring and/or the joining area is formed from at least one web.

24. The spark plug electrode system as recited in claim 22, wherein the ground electrode is a cylindrical ring, the center electrode is a cylinder, and the joining area includes a plurality of webs which each connect the ground electrode to the center electrode, the plurality of webs being separated from one another by free areas which are free from all materials.

25. The spark plug electrode system as recited in claim 24, wherein areas for the ground electrode between the webs include a first noble metal, areas of the center electrode between the webs include a second noble metal, and the webs are free of the first noble metal and the second noble metal.

26. A spark plug, comprising:

a spark plug electrode system including a ground electrode and a center electrode, which are connected to each other by a joining area, formed from a one-piece spark plug electrode base body made up of spark plug electrode material; and a spark plug base body to which the spark plug electrode system is connected;

wherein the spark plug electrode material is a nickel-chromium alloy or a nickel-yttrium alloy.

27. A spark plug, comprising:

a ground electrode and a center electrode, which, between each other, define a spark gap, the ground electrode encompassing the center electrode, wherein the ground electrode and the center electrode are formed from a one-piece spark plug electrode base body made up of spark plug electrode material, and wherein the spark plug electrode material is a nickel-chromium alloy or a nickel-yttrium alloy;

wherein: (i) a first noble metal is situated at the ground electrode, in an area forming the spark gap between the ground electrode and the center electrode, and the first noble metal includes at least one section, which is free of the first noble metal, and/or (ii) a second noble metal is situated at the center electrode, in the area forming the spark gap between the ground electrode and the center electrode, and the second noble metal includes at least one section, which is free of the second noble metal.

* * * * *